US006811652B2

(12) United States Patent
Hollmark

(10) Patent No.: US 6,811,652 B2
(45) Date of Patent: Nov. 2, 2004

(54) MULTI-LAYER PAPER WEB AND A METHOD OF FORMING IT

(75) Inventor: Holger Hollmark, Stockholm (SE)

(73) Assignee: SCA Hygiene Products AB, Gothenburg (SE)

( * ) Notice: Subject to any disclaimer, the term of this patent is extended or adjusted under 35 U.S.C. 154(b) by 142 days.

(21) Appl. No.: 10/315,068

(22) Filed: Dec. 10, 2002

(65) Prior Publication Data

US 2003/0116292 A1 Jun. 26, 2003

Related U.S. Application Data

(60) Provisional application No. 60/341,269, filed on Dec. 20, 2001.

(51) Int. Cl.[7] ..... D21H 27/00

(52) U.S. Cl. ..... 162/109; 162/113; 162/117; 162/127; 162/132; 162/133; 162/135; 162/158; 162/184; 428/153; 428/171; 428/172; 428/178; 428/198; 428/212; 428/308.8; 428/311.11

(58) Field of Search ..... 162/109, 113, 162/117, 127, 132, 133, 135, 184; 428/153, 171, 172, 174, 178, 198, 212, 308.8, 311.11

(56) References Cited

U.S. PATENT DOCUMENTS

| | | | | | |
|---|---|---|---|---|---|
| 4,285,764 | A | * | 8/1981 | Salvai | 162/132 |
| 4,320,162 | A | * | 3/1982 | Schulz | 428/154 |
| 4,735,738 | A | * | 4/1988 | Willman | 510/330 |
| 4,994,053 | A | * | 2/1991 | Lang | 604/367 |
| 5,374,468 | A | * | 12/1994 | Babinsky et al. | 428/172 |
| 5,906,711 | A | * | 5/1999 | Barnholtz | 162/132 |

FOREIGN PATENT DOCUMENTS

| | | |
|---|---|---|
| EP | 0 613 979 A1 | 9/1994 |
| EP | 0 796 727 A2 | 9/1997 |
| EP | 0 829 576 A2 | 3/1998 |
| WO | 99/34055 | 7/1999 |

* cited by examiner

*Primary Examiner*—Peter Chin
(74) *Attorney, Agent, or Firm*—Young & Thompson

(57) ABSTRACT

A method of making a multilayer paper web, wherein at least two paper sheets are formed and dried separately to a dry content of no more than 80% by weight, imparting a three-dimensional pattern of alternating raised and recessed portions in the paper sheets during drying, combining the paper sheets into a multilayer web, in which void volumes are created between the raised and recessed portions of the combined sheets and drying the multilayer web.

11 Claims, 3 Drawing Sheets

MULTI-LAYER PAPER WEB AND A METHOD OF FORMING IT

TECHNICAL FIELD

The present invention refers to a method of making a multi-layer paper web. It further refers to a multi-layer paper web having a three-dimensional structure. Especially it refers to the production of tissue products such as toilet and kitchen paper, paper towels, handkerchiefs, wiping material and the like.

BACKGROUND OF THE INVENTION

It is very common to laminate two or more tissue paper plies in order to produce the final tissue product. Herewith a more flexible and softer tissue product is obtained as compared to if one single ply with a corresponding thickness and basis weight had been produced as for the laminated product. The absorbent capacity and the bulk are moreover improved.

The lamination of two or more tissue plies is often made by means of gluing. A mechanical embossing of the plies is also often performed before they are glued together. It is further known to laminate two plies only by means of a mechanical embossing, at which a mechanical joining of the plies occur in the embossing sites.

Through for example EP-A-796 727 it is known to first emboss two paper plies in a three dimensional structure with alternating raised and recessed portions, after which glue is applied to one of the plies and the two plies are joined in a press nip between two embossing rolls, so that the raised portions of the respective plies are glued to each other. A similar embossing procedure is shown in EP-A-738 588, according to which the glue also has a colouring effect.

U.S. Pat. No. 3,414,459 discloses laminating of tissue plies by a combined embossing and gluing procedure. The embossing is of so called foot-to-foot type according to which the raised protuberances of the embossed tissue plies are joined together. In U.S. Pat. Nos. 3,555,907 and 3,867,225 there are also disclosed a combined embossing and gluing process, but where the embossing is of so called nested type according to which the raised projections of one tissue ply will rest in and be joined to the depressions of the opposite ply.

There would however from a manufacturing point of view be a general advantage to be able to make a single ply tissue product. The downtime of the converting line would be considerably reduced and the speed of the converting machine could be increased. There are however difficulties to envisage process solutions for single ply tissue that would render the desired product properties in terms of softness and absorbency.

One way of achieving a single ply tissue product with possibly acceptable properties would be to join two or more individual layers in the wet state in the paper machine before the paper is pressed and dried, while striving to optimize the fibre structure and fibre properties in the individual layers. Two layers can be joined together in the wet state through several operations. One is to use a so called multilayer headbox, another is to form a second layer on top of a previously formed first layer and a third possibility is to couch together two separately formed layers.

There is however considerable doubt that any of the above mentioned methods of joining the wet layers would produce the required softness and absorbency to replace a multi-ply tissue. The reason is that there are difficulties to maintain the void volumes between the layers that seem to be necessary in order to provide the required flexibility of the material and the required pore volume for absorption.

The term "multi-ply" in this respect means that two or more paper sheets have been combined outside the paper machine in the converting line, such as by embossing and/or gluing, while the term "multi-layer" refers to that two or more sheets of paper have been combined in the paper machine in a wet or moist state, so that papermaking bonds are formed between the layers.

It is further known to impart a three-dimensional pattern in a moist paper web while drying the web. This can be done by so called through-air-drying (TAD), in which hot air is blown through the moist paper web while it is carried by a patterned drying fabric or belt. In connection with the TAD drying the pattern structure of the drying fabric is transferred to the paper web. This structure is essentially maintained also in wet condition of the paper, since it has been imparted to the wet paper web. A description of the TAD technique can be found in e g U.S. Pat. No. 3,812,000.

Through for example WO 99/34055 it is known to impart a three-dimensional a pattern in a moist paper web while drying the web by so called impulse drying and impulse embossing. The wet paper web is passed through a press nip comprising a rotatable roll which is heated and the paper web is given said three-dimensional pattern when passing through the press nip, either by means of a patterned wire and/or by the fact that the heated roll is provided with a pattern intended to be pressed into the paper web against a non-rigid holder-on, such as a felt. The three-dimensional pattern is in this case essentially maintained in wet condition of the paper, since it has been imparted to the wet paper web.

SUMMARY OF THE INVENTION

An object of the present invention is to provide a process of joining two or more sheets of paper in wet or moist condition and obtain a final product which possesses properties such as flexibility and absorption capacity which are comparative to those of a multi-ply product. The product could be defined as a single-ply multi-layer product.

This has according to the invention been provided by separately forming and drying at least two paper sheets to a dry content of no more than 80% by weight, imparting a three-dimensional pattern of alternating raised and recessed portions in the paper sheets during drying, combining the at least two paper sheets having a dry content of no more than 80% by weight into a multilayer web, in which void volumes are created between the raised and recessed portions of the combined sheets, drying the multilayer web.

In order to maintain a high bulk it is preferred that drying of the multilayer web is made without any considerable compression of the multilayer web.

The term "without any considerable compression" in this respect means that the drying technique used will not cause a compression or bulk reduction of the multilayer web of more than about 25%.

Examples of non-compressible drying techniques are through-air-drying (TAD) and infrared (IR) drying.

According to one embodiment of the invention drying and imparting said three-dimensional pattern in the separately formed paper sheets is made by impulse drying and impulse embossing, wherein the wet paper sheet is passed through a press nip comprising a rotatable roll which is heated so that the paper sheet when passing through the press nip is given said three-dimensional pattern either by means of a patterned wire and/or by the fact that the heated roll is provided with a pattern intended to be pressed into the paper sheet against a holder-on. The holder-on preferably has a non-rigid surface.

In an alternative embodiment drying and imparting said three-dimensional pattern in the separately formed paper sheets is made by through-air-drying (TAD) wherein the wet paper sheet is carried by a patterned wire or belt.

In a further embodiment an additional component, such as an absorbent material and/or spacing means is applied between the paper sheets before combining them.

The invention further refers to a multilayer paper web having a three-dimensional structure, said multilayer paper web comprising at least two paper sheets each of which having a three-dimensional pattern of alternating raised and recessed portions, said paper sheets being joined together point- or spotwise by papermaking bonds forming bonding sites, while leaving void volumes between the sheets and between the bonding sites.

DESCRIPTION OF DRAWINGS

The invention will now be described more in detail with reference to embodiments shown in the accompanying drawings.

DESCRIPTION OF EMBODIMENTS

Figure 1:
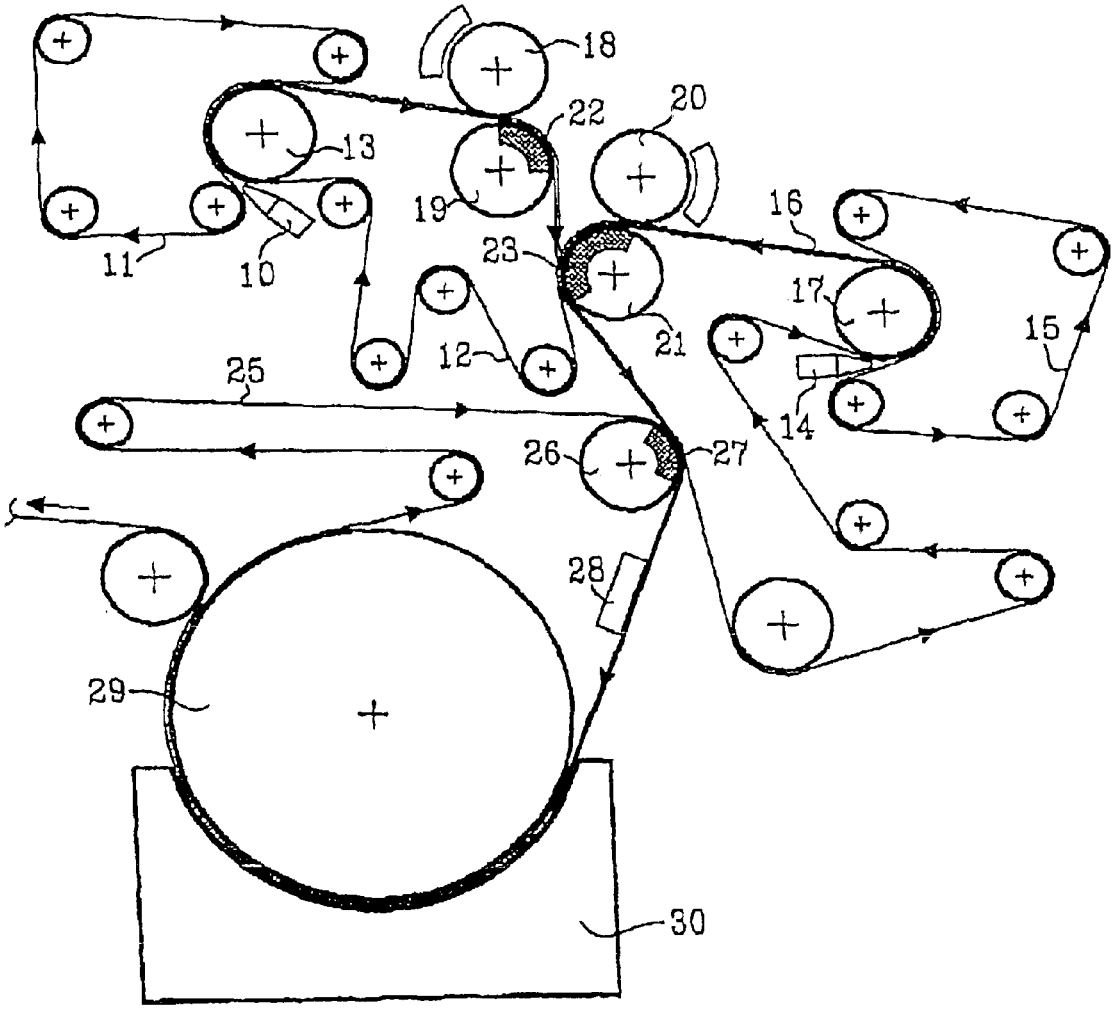
FIG. 1 is a schematic view of a machine configuration for the method according to the invention.
Figure 2:
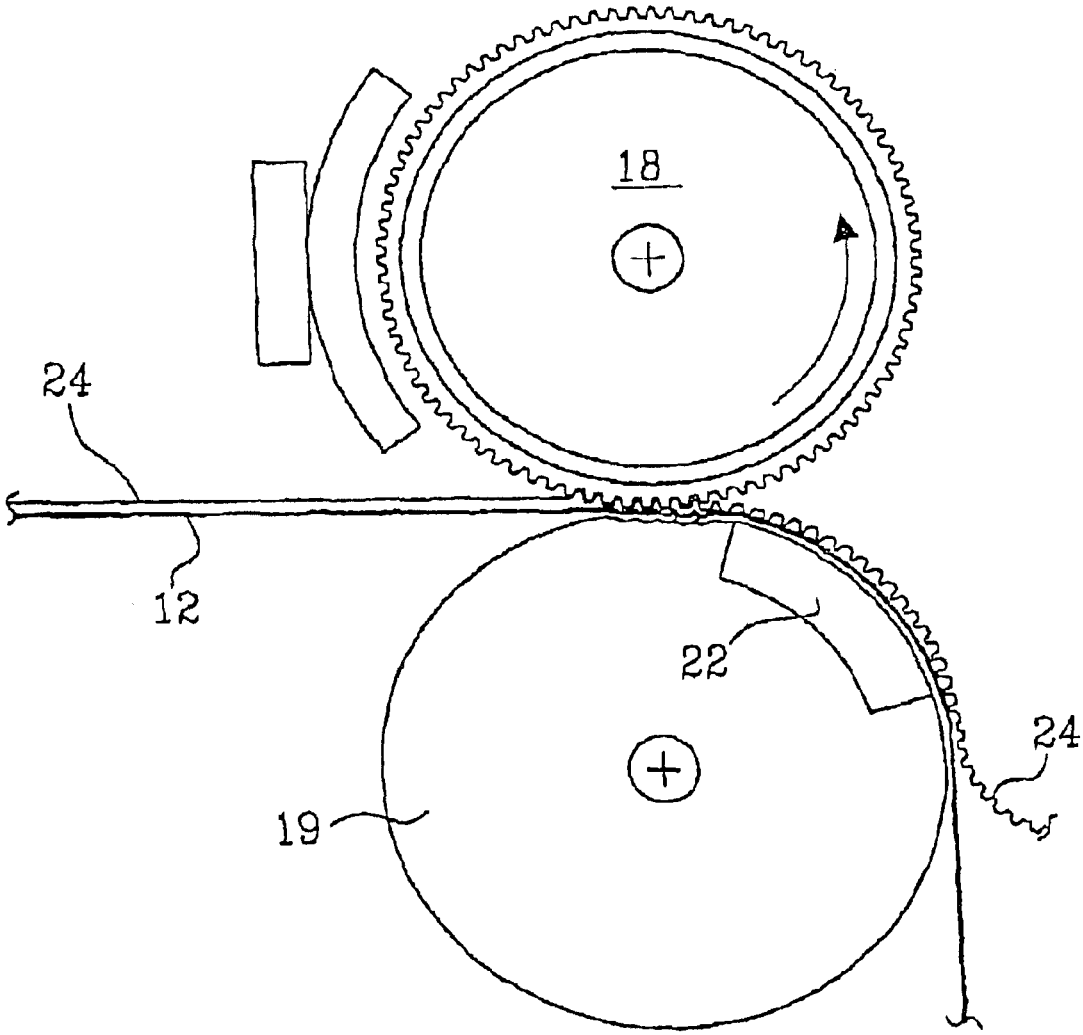
FIG. 2 shows on a larger scale an impulse drying unit.
Figure 3:
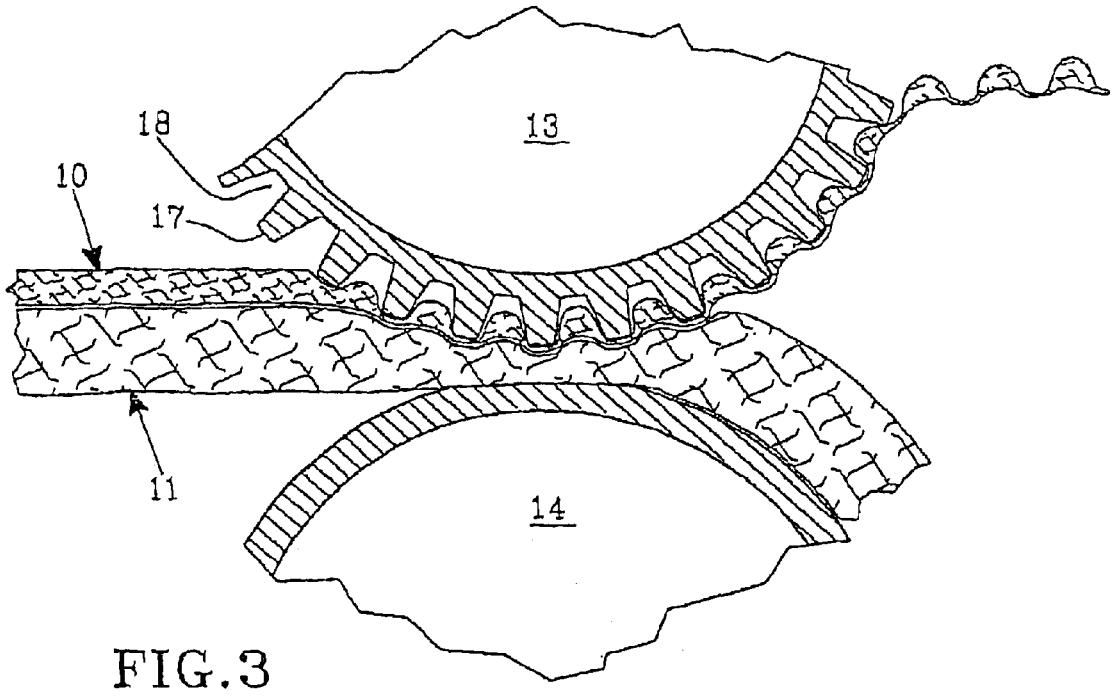
FIG. 3 shows the press nip of the impulse drying unit.

FIG. 1. shows schematically a machine configuration for making a two-layer paper web, and having a first twin-wire forming unit comprising a first headbox 10 delivering a fibre suspension jet into a nip created by a pair of tensioned forming wires or felts 11 and 12 both of which wrap around a rotating forming roll 13, and a second twin-wire forming unit comprising a second headbox 14 delivering a fibre suspension jet into a nip created by a pair of tensioned forming wires or felts 15 and 16 both of which wrap around a rotating forming roll 17. The forming rolls 13 and 17 may have a solid or open surface. In the case the forming rolls 13 and 17 have open surfaces, they may be supported with a vacuum. According to one embodiment the inner part of the twin wire nip is a felt 12; 16 and the outer part is a wire 11; 15.

The wet sheets supported by the wires or felts 12 and 16 may be further dewatered over suction boxes (not shown) and are each brought into an impulse drying nip between two rotatable rolls 18, 19 and 20, 21 respectively, at which the rolls 18 and 20 which are in contact with the paper sheets are heated to a temperature which is sufficiently high for providing drying of the paper sheet. The surface temperature of the heated rolls 18 and 20 can vary depending on such factors as the moisture content of the paper sheet, thickness of the paper sheet, the contact time between the paper sheet and the roll and the desired moisture content of the completed paper product. The surface temperature should of course not be so high that the paper sheet is damaged. An appropriate temperature should be in the interval 100–400° C., preferably 150–350° C. and most preferably 200–350° C.

The paper sheet is pressed against the heated roll 18; 20 by means of the respective wire or felt 12; 16 and the backing roll 19; 21, which may or may not be provided with a soft nonrigid surface layer, e g rubber or another resilient material. A very rapid steam generation takes place in the interface between the heated roll 18; 20 and the moist paper sheet, at which the generated steam on its way through the paper sheet carries away water.

Instead of the backing roll 19; 21 a press shoe or the like may be used as a holder-on in the impulse drying press nip. The backing roll 19; 21 is in the embodiment shown a suction pressure roll with a vacuum 22; 23 such that the paper web is retained on the felt or wire 12; 16.

Simultaneously with the impulse drying the paper sheet 24 is given a three-dimensional structure by the fact that the heated roll 18; 20 is provided with an embossing pattern in the form of alternating raised and recessed portions 25, 26. This structure is substantially maintained also in a later wetted condition of the paper, since it has been imparted the wet paper sheet in connection with drying thereof.

The paper sheet 24 may be pressed against a non-rigid surface, e g a compressible press felt 12; 16. The backing roll 19; 21 may also have a flexible surface, e g an envelope surface of rubber. This is however not necessary in order to accomplish the materials and processes of the present invention. The paper sheet 24 is herewith given a three-dimensional structure having a total thickness greater than that of the unpressed paper. By this a high bulk, high absorption and high softness of the paper are achieved. The paper further becomes elastic. At the same time there is obtained a locally varying density in the paper.

The paper sheet 24 may also be pressed against a hard surface, e g a wire 12; 16 and/or a roll 14 having a rigid surface, at which the pattern of the heated roll 18; 22 is pressed into the paper sheet under heavy compression of the paper just opposite the impressions, while the portions therebetween are kept uncompressed.

The three-dimensional pattern imparted in the paper sheet may also be provided by a pattern wire or belt wrapping the heated cylinder 18; 20, which in this case does not need to be patterned.

The three-dimensional patterns imparted to the paper sheets in the two impulse drying and embossing stations may be the same or different.

The paper sheets are not dried to the final dryness in the impulse drying and embossing stations, but have a moisture content of at least 20% by weight, preferably at least 30% by weight, when leaving the impulse drying and embossing stations.

After the impulse drying and embossing stations the two paper sheets 24*a* and *b* are joined by letting one sheet be picked up by the other sheet while this is still on its felt 16 wrapping the backing roll 21 with an extended suction zone 23. After that the two joined sheets are picked up from the felt 16 by a wire over a roll 26 having a suction zone 27. Further dewatering may, if necessary, occur by suction box 28.

The combined web is then dried by being passed over a drying drum 29 having an air hood 30 mounted thereover to direct heated air against and through the web on the drum surface 29. This drying technique is often called through-air-drying (TAD) and is a non-compressive drying producing high bulk and absorbent tissue.

Other non-compressive drying techniques that may be used instead of TAD is for example IR dryers. The dryness of the paper web after the non-compressive drying should be at least 90% or preferably a dryness which is in equilibrium with the ambient air.

It would also be possible to use another drying and imprinting technique than impulse drying and embossing for the drying and imprinting of the individual sheets. Such an alternative technique is TAD using an imprinting fabric or belt.

Figure 4:
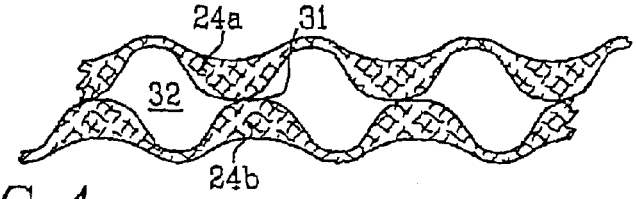
FIG. 4 illustrates a two-layer paper web according to the invention.

The combined paper sheets 24*a, b* are when dried on the heated cylinders 18;20 joined together point- or spotwise by papermaking bonds forming bonding sites 31, while leaving void volumes 32 between the sheets 24*a, b* and between the bonding sites 31. This is illustrated in FIG. 4. The void volumes 32 between the sheets contributes in providing the required absorbency and flexibility of the final product.

Figure 5:
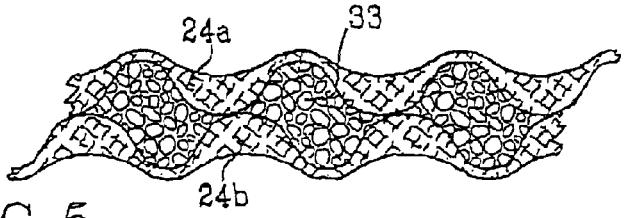
FIG. 5 illustrates a two-layer web containing an additional components in the void volumes between the layers.

These void volumes 32 may according to one embodiment of the invention, illustrated in FIG. 5, contain an additional component 33, such as an absorbent material and/or spacing means. The absorbent material may for example be a so called superabsorbent material, and the multilayer web containing the superabsorbent material may be used as an absorbent layer in an absorbent article such as sanitary napkins, panty liners, diapers and incontinence guards or as highly-absorbent wiping material.

Spacing means may be a porous moisture insensitive material such as a polymeric foam or synthetic fibrous material, which helps maintaining the bulk of the multilayer web when wet.

The invention is not limited to the embodiments described and shown but several modifications are possible within the scope of the claims.

What is claimed is:

1. A method of making a multilayer paper web, which comprises:

separately forming and drying at least two paper sheets to a dry content of no more than 80% by weight, imparting a three-dimensional pattern of alternating raised and recessed portions in the paper sheets during drying, combining the at least two paper sheets having a dry content of no more than 80% by weight into a multilayer web, in which void volumes are created between the raised and recessed portions of the combined sheets, and drying the multilayer web.

2. A method of making a multilayer paper web as claimed in claim 1, wherein the drying of the multilayer web is made without any considerable compression of the multilayer web.

3. A method of making a multilayer paper web as claimed in claim 2, wherein the non-compressible drying of the multilayer web is made by through-air-drying (TAD) or infrared (IR) drying.

4. A method of making a multilayer paper web as claimed in claim 1, wherein the drying and imparting of the three-dimensional pattern in the separately formed paper sheets is made by impulse drying and impulse embossing, the wet paper sheet is passed through a press nip comprising a rotatable roll which is heated, and the paper sheet when passing through the press nip is given said three-dimensional pattern either by means of a patterned wire and/or by the fact that the heated roll is provided with a pattern intended to be pressed into the paper web against a holder-on.

5. A method of making a multilayer paper web as claimed in claim 4, wherein the holder-on has a non-rigid surface.

6. A method of making a multilayer paper web as claimed in claim 1, wherein the drying and imparting of the three-dimensional pattern in the separately formed paper sheets is made by through-air-drying (TAD), and the wet paper sheet is carried by a patterned wire or belt.

7. A method of making a multilayer paper web as claimed in claim 1, wherein an absorbent material is applied between the paper sheets before combining them.

8. A method of making a multilayer paper web as claimed in claim 1, wherein spacing means are applied between the paper sheets before combining them.

9. A multilayer paper web having a three-dimensional structure, and comprising at least two paper sheets, each of which having a three-dimensional pattern of alternating raised and recessed portions, said paper sheets being joined together point- or spotwise by papermaking bonds forming bonding sites, while leaving void volumes between the sheets and between the bonding sites.

10. A multilayer paper as claimed in claim 9, wherein an absorbent material is contained in the void volumes between the sheets.

11. A multilayer paper as claimed in claim 9, wherein spacing means are contained in the void volumes between the sheets.

* * * * *